US007198068B2

(12) United States Patent
Dixon et al.

(10) Patent No.: US 7,198,068 B2
(45) Date of Patent: Apr. 3, 2007

(54) CASSETTE PIGTAILING MACHINE FOR A COIL SPRING

(75) Inventors: Jeffrey Paul Dixon, Oakville (CA); Wayne Frederick James Couch, Waterdown (CA); Martin John Seeds, Milton (CA); Thomas Marvin Sine, Milton (CA); Oscar Gaetan, Hamilton (CA); Terrence Joseph Nova, Milton (CA)

(73) Assignee: Meritor Suspension Systems Co., Troy, MI (US)

( * ) Notice: Subject to any disclaimer, the term of this patent is extended or adjusted under 35 U.S.C. 154(b) by 278 days.

(21) Appl. No.: 10/651,127

(22) Filed: Aug. 28, 2003

(65) Prior Publication Data

US 2005/0045241 A1 Mar. 3, 2005

(51) Int. Cl.
*B21F 35/02* (2006.01)
*B21F 3/10* (2006.01)

(52) U.S. Cl. ..... 140/103; 72/371; 72/137; 72/139

(58) Field of Classification Search ..... 140/103; 72/306, 137, 138, 139, 140, 371
See application file for complete search history.

(56) References Cited

U.S. PATENT DOCUMENTS

| | | | | |
|---|---|---|---|---|
| 16,483 A | | 1/1857 | Harrison, Jr. | |
| 477,525 A | | 6/1892 | Ferrell | |
| 720,169 A | | 2/1903 | Mills | |
| 2,335,423 A | | 11/1943 | Knoop | |
| 2,692,620 A | | 10/1954 | Sjobohm | |
| 3,024,833 A | | 3/1962 | Kelly | |
| 3,121,538 A | | 2/1964 | Klingensmith et al. | |
| 3,456,893 A | | 7/1969 | Michelson | |
| 4,424,695 A | * | 1/1984 | Kirchhoff et al. | 72/128 |
| 4,444,036 A | * | 4/1984 | Shibata et al. | 72/138 |
| 4,571,973 A | | 2/1986 | Morita | |
| 4,672,549 A | | 6/1987 | Saxton | |
| 4,682,394 A | | 7/1987 | Wells et al. | |
| 4,715,202 A | | 12/1987 | Shibata et al. | |
| 4,945,744 A | * | 8/1990 | Lienert | 72/137 |
| 4,967,580 A | * | 11/1990 | Morita | 72/137 |
| 5,454,249 A | | 10/1995 | Kempf et al. | |
| 5,875,664 A | | 3/1999 | Scott et al. | |
| 6,474,125 B1 | * | 11/2002 | Denis et al. | 72/306 |

FOREIGN PATENT DOCUMENTS

| | | |
|---|---|---|
| EP | 0 322 605 A | 7/1989 |
| EP | 0 352 933 A | 1/1990 |
| JP | 63 188439 A | 8/1988 |

* cited by examiner

*Primary Examiner*—Dmitry Suhol
(74) *Attorney, Agent, or Firm*—Carlson, Gaskey, & Olds

(57) ABSTRACT

A pigtailing machine includes a B forming head and a support pedestal secured to a cassette base. The cassette base is located upon a base which mounts the A forming head to provide for a relatively quick changeover should another double pigtail coil spring need be manufactured. By fixing the forming head and the support pedestal to the cassette base alignment and proper manufacture of the spring is assured. Alternatively, the A forming head is also mounted to the cassette base.

20 Claims, 2 Drawing Sheets

CASSETTE PIGTAILING MACHINE FOR A COIL SPRING

BACKGROUND OF THE INVENTION

The present invention relates to the forming of a coil spring having pigtails at each end, and more particularly to a machine for efficiently forming the pig tails.

In many instances, it is desirable to have reduced diameter ends or "pigtails" on a wound coil spring. One example application for such springs is in automotive suspension systems. A reduced diameter at one end of the spring can be beneficial for efficiency in spring height and operating travel.

In a typical coil spring forming manufacturing method, a cut-to-length bar is wound around a solid mandrel that sets the inside diameter of the coil spring. One end coil of the spring can be formed smaller than the next coil of the spring using this technique to provide a pigtailed spring. The mandrel for such springs typically has a smaller diameter on one end to form the reduced end of the spring.

It is also beneficial in many circumstances to also reduce the diameter of the opposite end coil of the spring for similar size and performance reasons. A secondary pigtailing operation is performed after the mandrel has been removed. Typically a separate pigtailing machine performs the pigtailing operation.

Conventional pigtailing machines typically include an A head which receives the previously pigtailed coil and a B head which forms the second pigtail coil. Between the heads, are numerous adjustable fixtures, supports, and clamping arrangements. The adjustable components allow a pigtail of a desired shape to be formed onto an opposite end of coil springs of various sizes and shapes.

Disadvantageously, setup for conventional pigtailing machines is quite extensive. Each adjustable component must be accurately and precisely aligned relative the heads. The setup time for each spring type increases the overall production cycle time and results in a lower manufacturing efficiency. Additionally, the adjustable components may shift over time due to the aggressive environment in which a pigtailing machine operates. Shifting in any of the adjustable supports may result in marking of the spring surface which may lead to a stress concentration and potential early fatigue of the spring during service.

Accordingly, it is desirable to provide a pigtailing machine and forming approach that provides for a double pigtail while reducing cycle time, minimizes marking and assures an accurately formed double pigtailed coil spring.

SUMMARY OF THE INVENTION

The pigtailing machine according to the present invention provides an A forming head, a B forming head, a drive system for the B forming head, a base, a support pedestal, and a controller. The B forming head and the pedestal are secured to a cassette base. The cassette base is located upon the base to provide for a relatively quick changeover should another double pigtail coil spring type need be manufactured. By fixing the forming head and the support pedestal to the cassette base, alignment and proper manufacture of the spring is assured. Alternatively, the A forming head may also be mounted to the cassette base.

The present invention therefore provides a pigtailing machine and forming approach that provides for a double pigtail while reducing cycle time, minimizes marking and assures an accurately formed double pigtailed coil spring.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1A:
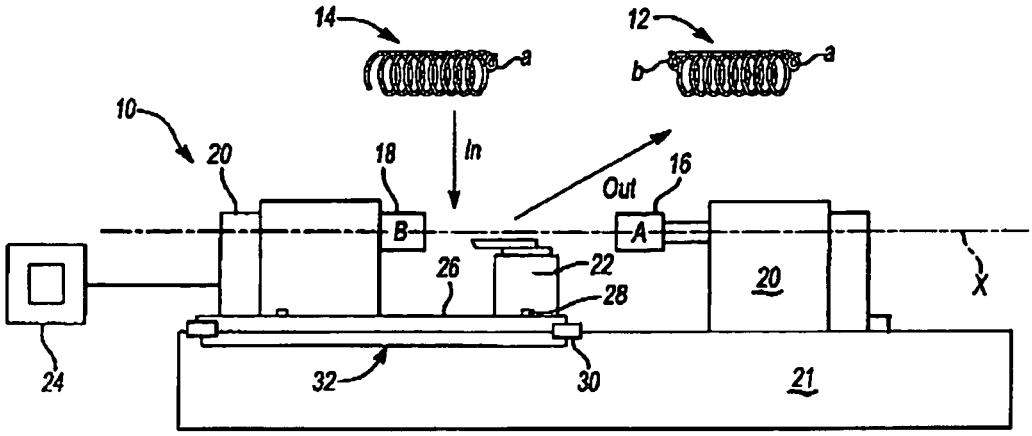
FIG. 1A schematically illustrates a system for forming coil springs designed according to this invention.

FIG. 1A illustrates a general schematic view of a pigtailing machine 10 which forms a double pigtailed coil spring 12 which has a pigtail at end a and end b out of a coil spring which has a single pigtail 14 at end a. The pigtailing machine 10 generally includes an A forming head 16, a B forming head 18, a drive system 20 for the B forming head 18, a base 21, a support pedestal 22 and a controller 24 (illustrated schematically).

Preferably, the B forming head 18, and the pedestal 22 are secured to a cassette base 26 through fasteners 28 such as bolts or the like. The cassette base 26 is located upon the base 21 and locked thereto through locks (illustrated schematically at 30) to provide for a relatively quick changeover should another double pigtail coil spring need be manufactured. That is, a cassette 32 which includes at least the B forming head 18 and the pedestal 22 secured to the cassette base 26 is a dedicated die for the manufacture of a single specific double pigtail coil spring type. By fixing the B forming head 18 and the support pedestal 22 to the cassette base 26 alignment and proper manufacture of the spring is assured without necessitating setup for each different spring produced by the machine 10.

Figure 1B:
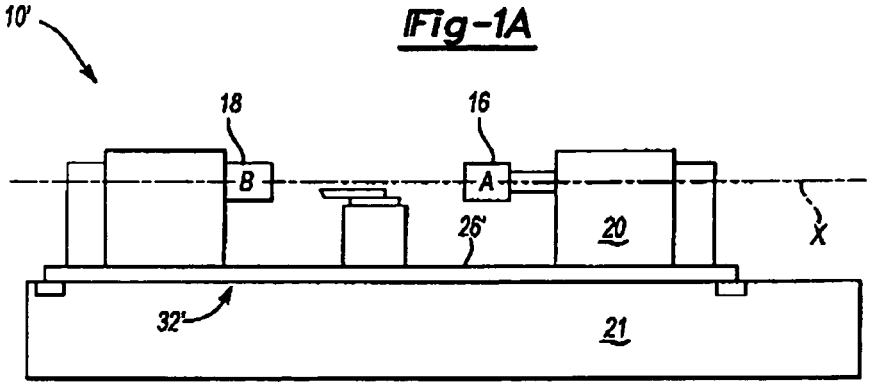
FIG. 1B schematically illustrates a system for forming coil springs designed according to this invention.

The A forming head 16 may be mounted directly to the base 21 to minimize expense of the cassette 32. Alternatively, a pigtailing machine 10' may mount the A forming head 16, the B forming head 18, and the support pedestal 22 to the cassette base 26 as a cassette 32' at a slight increase in expense (FIG. 1B).

Figure 2:
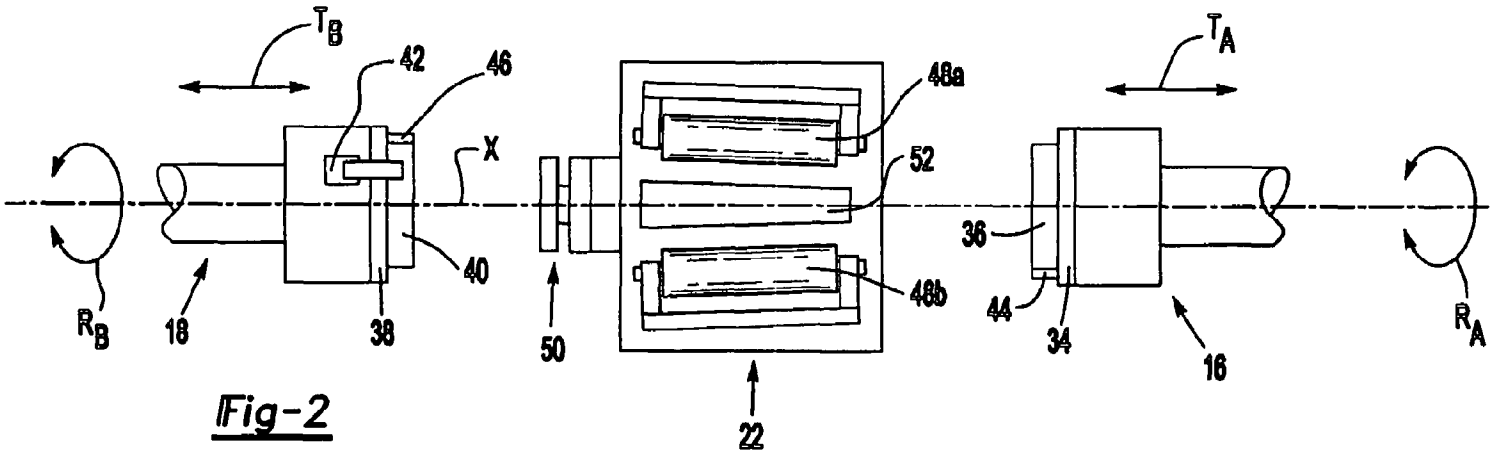
FIG. 2 schematically illustrates an expanded top view of the system.

Referring to FIG. 2, the A forming head 16 and the B forming head 18 are arranged along an axis X which is also the centerline of the coil spring 12 when mounted thereto. The A forming head 16 includes a face plate 34 mounted thereto. An A die 36 is mounted to the face plate 34 which receives the previously pigtailed coil of the coil spring 12 (FIG. 1A). The A forming head 16 preferably rotates and axially translates relative maxis X as Indicated by arrows $R_A$ and $T_A$.

The B forming head 18 includes a face plate 38 and a B die 40 mounted to the face plate 38. The B die 40 is preferably mounted offset from axis X. The B forming head 18 further includes a dog latch 42 mounted axially along the B forming head 18 to lock the opposite coil (initially the non-pigtailed coil 14; FIG. 1A) to the B die 40. The dog latch 42 opens and closes in response to the controller 24 to trap the coil end to the B die 40.

The B forming head 18 preferably rotates and axially translates relative axis X as indicated by arrows $R_B$. and $T_B$ The drive system 20 for the B forming head 18 preferably rotates the B forming head 18 about axis X which rotates B die 40 in an eccentric path relative axis X to form the second pigtailed end of the coil spring 12.

Figure 3A:
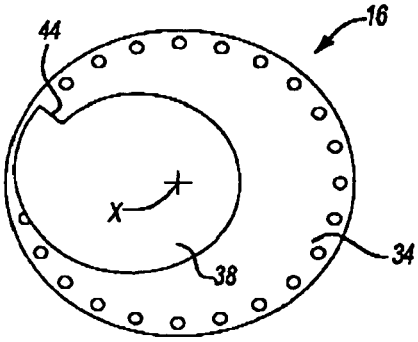
FIG. 3A is a front face view of the forming head A.
Figure 3B:
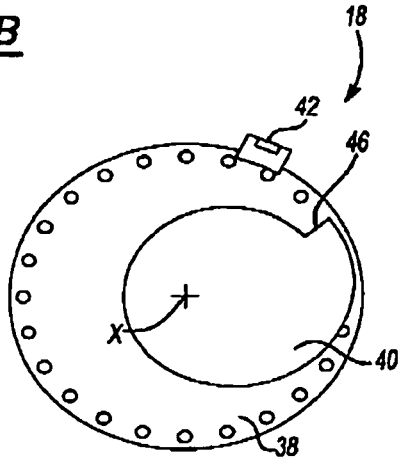
FIG. 3B is a front face view of forming head B.

The A die 36 and the B die 40 include a step 44, 46 which respectively receive and abut the distal end of the coil spring 12 (also illustrated in FIGS. 3A, 3B). The A forming head 16 and the B forming head 18 are selectively rotated and translated in response to the controller 24 to initially locate the coil spring therebetween and lock the coil spring into place along axis X.

The support pedestal 22 includes a first and a second roller 48*a*, 48*b* mounted thereto. The rollers 48*a*, 48*b* are preferably located adjacent axis X and spaced therefrom. The rollers 48*a*, 48*b* assure that the shape of the spring 12 is maintained during the forming operation which includes rotating the B die 40 such that the (initially not pigtailed) coil of the coil spring 12 is rotated about the B-die 40 to form the pigtail coil. The rollers 48*a*, 48*b* are mounted directly to the support pedestal 22 without the heretofore requirement of an adjustment mechanism which may shift position and potentially mark the spring.

A tangent clamp 50 is located between the support pedestal 22 and the B forming 18 to further support the coil spring during the forming operation. The tangent clamp 50 preferably engages the second to the last coil of the coil spring.

Figure 4:
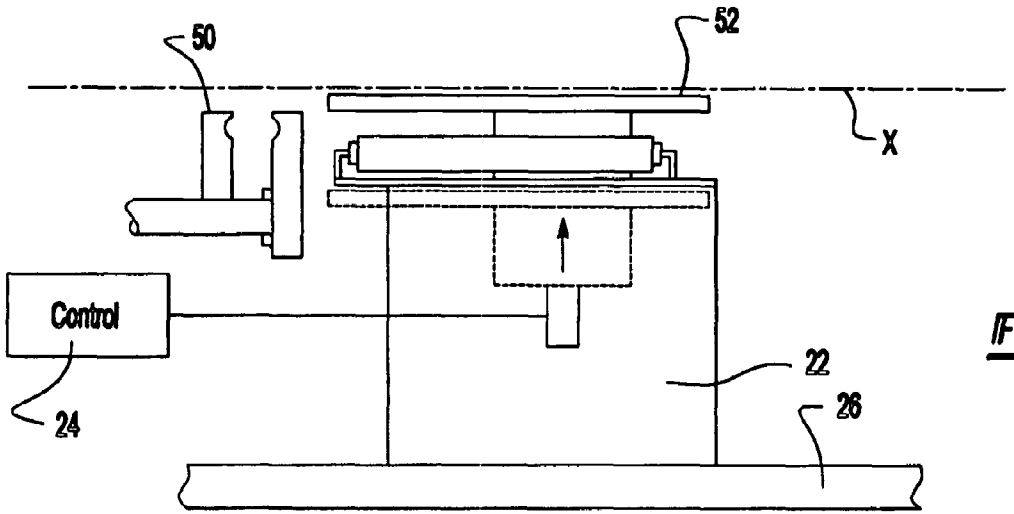
FIG. 4 schematically illustrates a side view of a support pedestal with a lifter in an actuated position.

A lifter 52 is preferably located between the rollers 48*a*, 48*b*. The lifter 52 selectively extends from the support pedestal 22 in response to the controller 24 (FIG. 4) to assist in extraction of the finished double pigtailed coil spring 12. That is, the A forming head 16 and the B forming head 18 at least partially retract and the lifter moves toward axis X to lift the finished double pigtailed coil spring 12 away from the rollers 48*a*, 48*b* such that the spring 12 may be transported to the next operation.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A pigtailing machine comprising:

an A forming head mounted for rotation about an axis, said A forming head to receive a previously pigtailed coil of a coil spring;

a B forming head located along said axis, said B forming head to initially receive a non-pigtailed coil of the coil spring and operable to pigtail the non-pigtailed coil to form a double pigtailed coil spring;

a cassette base wherein said B forming head is mounted to said cassette base;

a support pedestal located between said A forming head and said B forming head to support the coil spring, said support pedestal being mounted to said cassette; and a main base wherein said cassette base is selectively mounted to said main base with at least said B forming head and said support pedestal being selectively movable with said cassette base relative to said main base.

2. The pigtailing machine according to claim 1 wherein said A forming head rotates and axially translates relative to said axis.

3. The pigtailing machine according to claim 1 wherein said B forming head rotates and axially translates relative to said axis.

4. The pigtailing machine according to claim 1 including a face plate mounted to said B forming head and a B die mounted to said face plate, said B die including a latch to fix the non-pigtailed coil of the coil spring to said B die.

5. The pigtailing machine according to claim 4 wherein said B die rotates in an eccentric path relative to said axis.

6. The pigtailing machine according to claim 1 including a plurality of rollers mounted to said support pedestal to maintain a desired shape of the coil spring as said B forming head forms the non-pigtailed coil into a pigtailed coil to provide the double pigtailed coil spring.

7. A pigtailing machine comprising:

an A forming head mounted for rotation about an axis, said A forming head to receive a previously pigtailed coil of a coil spring;

a B forming head located along said axis, said B forming head to initially receive a non-pigtailed coil of the coil spring and operable to pigtail the non-pigtailed coil to form a double pigtailed coil spring;

a cassette base wherein said B forming head is mounted to said cassette base;

a support pedestal located between said A forming head and said B forming head to support the coil spring, said support pedestal being mounted to said cassette base; and a main base supporting both said A forming head and said B forming head wherein said cassette base is selectively mounted to said main base with a lock mechanism.

8. The pigtailing machine according to claim 7 wherein said A forming head is mounted to said main base independently of said cassette base such that said B forming head, said support pedestal, and said cassette base are selectively removable from said main base together as a unit leaving said A forming head mounted to said main base.

9. The pigtailing machine according to claim 7 wherein said A forming head is mounted to said cassette base such that said A forming head, said B forming head, said support pedestal, and said cassette base are removable together as a unit from said main base.

10. A pigtailing machine comprising:

an A forming head mounted for rotation about an axis, said A forming head to receive a previously pigtailed coil of a coil spring;

a B forming head located along said axis, said B forming head to initially receive a non-pigtailed coil of the coil spring and operable to pigtail the non-pigtailed coil to form a double pigtailed coil spring;

a cassette base wherein said B forming head is mounted to said cassette base;

a support pedestal located between said A forming head and said B forming head to support the coil spring, said support pedestal being mounted to said cassette base; and a face plate mounted to said A forming head and an A die mounted to said face plate, the A die to support the previously pigtailed coil of the coil spring.

11. A pigtailing machine comprising:

an A forming head mounted for rotation about an axis, said A forming head including an A die for receiving a previously pigtailed coil of a coil spring;

a B forming head mounted for rotation about said axis, said B forming head including a B die that receives a non-pigtailed coil of the coil spring and is operable to pigtail the non-pigtailed coil to form a double pigtailed coil spring;

a cassette base wherein said B forming head is mounted to said cassette base;

a support pedestal located between said A forming head and said B forming head, said support pedestal including a plurality of rollers to maintain a desired shape of the coil spring as said B forming head forms the non-pigtailed coil into a pigtailed coil to provide the double pigtailed coil spring, and wherein said support pedestal is mounted to said cassette base such that said B forming head and said support pedestal are movable together with said cassette base; and a main base, said cassette base being selectively mounted to said main base with at least said B forming head and said support pedestal being movable together with said cassette base relative to said main base.

12. The pigtailing machine according to claim 11 wherein said cassette base is selectively mounted to said main base with a lock mechanism.

13. The pigtailing machine according to claim 12 wherein said A forming head is mounted to said main base independently of said cassette base such that said B forming head, said support pedestal, and said cassette base are selectively removable from said main base together as a single unit leaving said A forming head mounted to said main base.

14. The pigtailing machine according to claim 12 wherein said A forming head is mounted to said cassette base such that said A forming head, said B forming head, said support pedestal, and said cassette base are removable together as a single unit from said main base.

15. The pigtailing machine according to claim 12 including an A face plate mounted to said A forming head with said A die being mounted to said A face plate, and a B face plate mounted to said B forming head with said B die being mounted to said B face plate, and wherein both said B and said A forming heads rotate and translate relative to said axis with said B die rotating in an eccentric path relative to said axis.

16. A method for forming a double pigtailed coil spring comprising the steps of:

(a) mounting an A forming head for rotation about an axis, the A forming head including an A die receiving a previously pigtailed coil of a coil spring;

(b) mounting a B forming head for rotation about the axis, the B forming head including a B die receiving a non-pigtailed coil of the coil spring;

(c) mounting the B forming head to a cassette base;

(d) mounting a support pedestal to the cassette base at a position between the A forming head and the B forming head to support the coil spring, and selectively mounting the cassette base to a main base such that at least the B forming head and the support pedestal are movable together as a unit with the cassette base relative to the main base; and (e) pigtailing the non-pigtailed coil with the B die to form a double pigtailed coil spring.

17. The method according to claim 16 including mounting a plurality of rollers to the support pedestal to maintain a desired shape of the coil spring during performance of step (e).

18. A method for forming a double pigtailed coil spring comprising the steps of:

(a) mounting an A forming head for rotation about an axis, the A forming head including an A die receiving a previously pigtailed coil of a coil spring;

(b) mounting a B forming head for rotation about the axis, the B forming head including a B die receiving a non-pigtailed coil of the coil spring;

(c) mounting the B forming head to a cassette base;

(d) mounting a support pedestal to the cassette base at a position between the A forming head and the B forming head to support the coil spring;

(e) pigtailing the non-pigtailed coil with the B die to form a double pigtailed coil spring; and (f) mounting the cassette base to a main base, and removing the B forming head, the support pedestal, and the cassette base together as a single unit from the main base for replacement with a second cassette base for manufacturing a different type of double pigtailed coil spring.

19. The method according to claim 18 including defining the single unit as a first cassette base for forming a single specific type of double pigtail coil spring, and selecting the second cassette base from a plurality of available cassette bases each of which form a different type of double pigtailed coil spring.

20. The method according to claim 18 including mounting the A forming head to the cassette base and wherein step (f) includes removing the A forming head, the B forming head, the support pedestal, and the cassette base together as a single unit from the main base for replacement with the second cassette base.

* * * * *